US007033110B2

(12) United States Patent
Parker

(10) Patent No.: US 7,033,110 B2
(45) **Date of Patent: *Apr. 25, 2006**

(54) DRAINAGE SUPPORT MATRIX

(76) Inventor: Alton F. Parker, 16 Tracey Ct., Clifton Park, NY (US) 12065

( * ) Notice: Subject to any disclaimer, the term of this patent is extended or adjusted under 35 U.S.C. 154(b) by 64 days.

This patent is subject to a terminal disclaimer.

(21) Appl. No.: 10/808,641

(22) Filed: Mar. 25, 2004

(65) Prior Publication Data

US 2005/0175419 A1 Aug. 11, 2005

Related U.S. Application Data

(63) Continuation-in-part of application No. 10/775,459, filed on Feb. 10, 2004, now Pat. No. 6,866,447.

(51) Int. Cl.
*E02B 13/00* (2006.01)

(52) U.S. Cl. ..... 405/50; 405/36; 405/43; 52/169.5

(58) Field of Classification Search ..... 405/43–50; 52/169.5

See application file for complete search history.

(56) References Cited

U.S. PATENT DOCUMENTS

| | | | | |
|---|---|---|---|---|
| 3,965,686 | A * | 6/1976 | Saito et al. | 405/43 |
| 4,019,326 | A * | 4/1977 | Herveling et al. | 405/45 |
| 4,995,759 | A * | 2/1991 | Plowman et al. | 405/43 |
| 5,152,892 | A * | 10/1992 | Chambers | 210/493.4 |
| 6,527,474 | B1 * | 3/2003 | Nabeshima | 405/43 |
| 6,702,517 | B1 * | 3/2004 | Goddard | 405/45 |
| 6,866,447 | B1 * | 3/2005 | Parker | 405/50 |

* cited by examiner

*Primary Examiner*—Frederick L. Lagman
(74) *Attorney, Agent, or Firm*—Schmeiser, Olsen & Watts

(57) ABSTRACT

A non-biodegradable, unitary drainage device of flexible character. The invention features a monolithic, skeletal construct consisting of stacked, planar or poly-formational arrays of quasi-tubular, tube or rod supports, termed "stand-off" elements. Actual positioning of the supports in their arrays is varied, with parallel interleaving, cross-linking and intertwining of supports to acquire varying degrees of strength and flexibility. Depending on specific function to be performed, optional covering sheet(s) of differing materials, that provide either particulate filtering or fluid impermeability (sealing), may be used with the various matrices. A different modality is also shown, wherein rods are mixed with tubules or perforated tubes to acquire the analogous structures, for use with great overburdens of stone or soil.

32 Claims, 9 Drawing Sheets

DRAINAGE SUPPORT MATRIX

CROSS-REFERENCES TO RELATED APPLICATIONS

This is a Continuation-in-Part of U.S. patent application Ser. No. 10/775,459, filed on Feb. 10, 2004, now U.S. Pat. No. 6,866,447, by the same inventor, for MULTI-USE FLUID COLLECTION AND TRANSPORT APPARATUS, and for which priority under 35 USC 119(e) and 120 is hereby claimed.

STATEMENT REGARDING FEDERALLY SPONSORED RESEARCH OR DEVELOPMENT

Not Applicable

BACKGROUND OF THE INVENTION

1. Field of the Invention

This invention relates generally to devices and constructs used to enhance subterranean drainage from building structures and entrenchments, such as walls, footings, foundations, as well as drainage from under garage and basement floors, where overburden of concrete exacerbates the collection of water. Specifically, this invention embodies a drain assembly improvement using a simplified support matrix that may be used with membranous covers, stone or other adjuncts. The matrix can sustain great overburden and is inherently pliable enough to be rolled and used as a flexible drain assembly (or "blanket-drain") over and around structures that would otherwise have to be served by more cumbersome and costly drainage systems.

2. Discussion of Relevant Art

It has long been a practice, in the construction industry, to provide some form of drainage to subterranean structures. Ground water seepage remains a problem in most non-arid regions of the world; and, building footings, garage floors (multi-level) and walls, facing surface and subsurface waters, have been most susceptible to water incursions. Many drainage devices have been provided, as well as adjuncts thereto, in order to provide adequate carry-off or transport of these undesired waters. Other patents, secured by the instant inventor, adequately cover the use of membranous coverings, such as filter fabric and impermeable sheeting. This paper will deal primarily with supporting structures for use with such coverings and expand on the basic concepts disclosed in the earlier, priority document.

Five disclosures are germane to this discussion, relative to the extant art: U.S. Pat. No. 3,965,686 ('686), issued Jun. 29, 1976, entitled DRAIN SHEET MATERIAL; U.S. Pat. No. 4,995,759 ('759), issued Feb. 26, 1991, entitled DRAINAGE TUBE CONSTRUCTION; U.S. Pat. No. 6,527,474 ('474), issued Mar. 4, 2003, entitled PAVEMENT DRAIN; U.S. Pat. No. 4,019,326 ('326), issued Apr. 26, 1977, entitled NONWOVEN HORIZONTAL DRAINAGE SYSTEM; and, U.S. Pat. No. 5,152,892 ('892), issued Oct. 6, 1992, entitled SPIRAL FILTER ELEMENT. All of these patents show, to some degree, the functionality of the coiled or spiral element in providing a conduit for fluids and having a relatively low or limited deformation character. However, it is in the careful study of each disclosure that one perceives, albeit suitability for intended purpose, its limitations when compared to the ready adaptability of the instant invention.

Issued to Saito et al., '686 details a compound sheet apparatus wherein a plurality of coils or internally strengthened tubules are parallel-arrayed, embedded in a non-woven fibrous material and disposed between two thin sheets of filter fabric. The apparatus' outer sheets are both porous and not suitable for placement against vertical walls. Most limiting is the necessity for the fibrous "filling" in which the tubules are embedded. When used for the specific purpose shown in '686, and notwithstanding the "filling", the apparatus appears to enjoy some flexibility; however, it seems intuitive that doubling the thickness of the "sandwich" would render such flexibility problematical. A characteristic of its construction, the use and dependence upon flow direction-constraining fibers, obviates a bi-directional emplacement of the apparatus on surfaces that may change in pitch direction or present a configuration that will not allow the use of a constrained-flow device.

A single-purpose drainage tube, for use in entrenchments, is shown in '759. The apparatus consists of a length of drain formed by a fixed tangential connection of parallel, equal-length sections of tubing, on a longitudinal axis that is perpendicular to the axes of the sections. The tubing consists of corrugated pipe; and, the assembly is completed by enveloping the above apparatus in a filter fabric. Although more stylized emplacements can be conceived for the apparatus, it appears that in the vertical drainage mode, turning of corners is impossible because the longitudinal fixation denies flexibility, as defined and required by the instant inventor.

Although not intended to flex, the pavement drain member of '474 is remarkable in that it is essentially a plain resin coil, albeit composed of two arcuate strands in fixed adjacency. The coil possesses a minimal gap between each annular section so as to obviate infusion of macadam, when it is set onto the asphalt medium. Water will infuse readily into the coils and be transported from the tarmac base. The primary motivation for the use of a stylized resin coil is to provide a structure having high overburden sustainability, a tunnel-like effect for transporting fluids and a possession of pseudo-homogeneity with the tarmac. The latter characteristic obviates coil interference during destruction (by grinding) of the tarmac.

The subsurface soil drainage system of '326 employs a porous mat, of non-woven fibers, in which is centrally embedded a tunnel-shaped agglomeration of heat-spun filaments of spiral or coil geometries. Subsurface waters, infusing the mat, are carried off through the tunnel of filaments, thus draining the surrounding soil. This apparatus requires a considerable thickness (and amount) of non-woven mat, making it unsuitable for the purposes of draining most structures. It also appears to lack the degree of flexibility required by the instant inventor.

Final to this review of relevant art is patent '892, for a spiral filter element possessing a special expansion-compression character. It is essentially a filter-covered spring, the coils of which are formed so that the gaps between the (analogical) annuli gradually increase in size from one coil end to the other. This predisposition of the element assures that, when vertically and operatively oriented, each discrete section of the coil is capable of sustaining the mass of the coil sections above it. Placed in a horizontal position, the spring gap variations of this element would defeat its purpose in any planar filtration ensemble.

Although for the most part, structure and soil draining, with concomitant filtration, is still performed using tiles, large amounts of stone and paper/fabric overlay (such as in drywell and septic usages), it is the instant inventor's contention that conscientious builders should transition to more efficient, effective and reliable draining and filtering modalities.

The instant invention provides an easily manipulated, flexible device that can be emplaced both adjacent to and beneath concrete structures and earthen constructs, as well wrapped about articles such as pipes, cylinders, corners and generally planar surfaces.

INCORPORATION BY REFERENCE

Because they show both the present state of the art in drainage devices having an internally channeled structure, as well as disclosing filtering adjuncts or various stand-off mechanisms, U.S. Pat. Nos. 3,965,686, 4,995,759, and 6,527,474, with the aforesaid priority application, are hereby incorporated by reference.

DEFINITIONS

Generally throughout this disclosure, words of description and claim shall have meanings given by standard English usage; however, certain words—preponderantly nouns—will be used that may have a more stylistic (in bold-face) meaning and are defined as follows:

arrangement—herein, the placement of basic support elements of the invention that will compose a duct-like member;

array—the order of two or more members, not necessarily planar;

blanket-drain—a term of art used herein to refer to the assembly/ensemble for, or method of, providing below grade/structure drainage using the inventor's preferred and alternate planar array embodiments;

construct—generally, an article or a building structure;

continual—having intermittent, or periodic, breaks or discontinuities;

continuous—having no breaks or discontinuities;

continuum—suggesting a continuity of some feature, such as a covering; cross-link—the attribute of joining/communicating between support elements or members of the invention;

coupling—herein, a physical fixed, rigid or movable linking of elements or members of the invention;

duct—a unit used for fluid transport, having generally an axially void, elongated, skeletal appearance, and typifying the member of the invention;

element—the basic constituent of the invention having a particular geometry (shape) that has ordinarily a central void, the void optional in arcuate or curved elements, and wherein the element itself comprises one or more of the geometries;

gang(ing)—a group(ing) of elements, of any shape, into one or more configurations in order to arrange the resultant members into other than purely planar arrays;

hoop—an element having (particularly) a generally circular geometry, also ring and annulus(lar) and, concatenated in a coil member;

integral—necessary to complete or in itself complete;

longeron—a longitudinal element that connects parts of a series, such as the centrally void, geometrical (elemental) parts of the invention;

member—a part of the invention consisting of an arrangement of its constituent elements, generally in-line;

membrane or membranous—of or pertaining to a porous/non-porous, thin sheet of material, irrespective of its composition, as opposed to mat or matted;

nodule—a projection of indefinite shape that can be, simply, a detent or dimple;

permeable—the quality of allowing a fluid, to pass through;

polyform—any form, assembly or construct using support elements or members of the invention;

quasi-tubular—the character of a support member that emulates a duct, but only to the extent that it is skeletal, elongated and sustains an axial void;

rigid—a physical property of an object wherein the object substantially resists deflection in a particular dimension (direction) or plane;

sandwich—the configuration made by placing one planar surface over, but set apart from a second surface, and wherein either may be virtual or referenced as face(s);

skeleton(tal)—the arrangement of elements of the invention manifesting a multi-aperture character;

stagger(ed)—the arrangement of members in a parallel posturing so that the elements of each may interleave with the other/others;

Standoff—a spacing support element or device that facilitates the setting apart of articles, e.g., membranes or stone;

stringer—generally, but not necessarily, an elongated structure that effects connection between the members (Cf. longeron);

support—generally used as an adjective with elements and members of the invention;

tubule—item (member) of the invention having a duct-like, skeletal appearance;

unitary—having wholeness, as in a single unit or monolith composed of plural members.

The above listing is not exhaustive. Certain other stylized terms, used previously or hereafter, are defined at the time of their first usage or placed in quotation marks and used with conventional wording.

BRIEF SUMMARY OF THE INVENTION

The deficiencies and limitations of the earlier art, namely complexity, cost and, in most instances, inflexibility are overcome by providing an inexpensive, easily applied innovation that facilitates collection and removal (transport) of subsurface or sub-structural waters. Additionally, a continued rollup or wrap-around capability of the instant drainage assembly enhances it greatly in respect of packaging and shipping, as well as use in the field.

Critical to the synthesis of the invention is the use of discrete elements, of a generally circular (hoop) or common geometric definition. These elements are concatenated, to form a coil, or are placed in a coaxial arrangement along a membrane (fixed thereto) or integral with, and along, at least one longeron. Both of these constructs give the resultant (member) a duct-/tunnel-like or quasi-tubular/conduit shape and, when arrayed by parallel alignment or cross-linking, emulate a planar/blanket article that possesses excellent flexibility, provides exceptional overburden support and facilitates fluid transport, after its passage through the spacings in, about and between the elements.

Defined, in only the general sense, as planar/sandwich morphology, the invention consists of an array of the strong, firm, non-biodegradable members that are, in a pristine sense, configured as supportive, stand-off elements that optionally bear a porous (or impermeable) membranous covering of geo-textile filter fabric (or sheet plastic) on at least one face of the array. Depending on the use of this relatively flexible assembly, the other face of the array may bear the same type of membranous covering or no covering at all, save for an optional mesh. The latter (mesh) is employed, at a manufacturer's discretion, to enhance the structural integrity of the assembly and is apparent in but one modality of the invention as a crosshatch, or network, of longerons and/or stringers.

Members may also be fixed to the covering(s) by any adhesive suitable for a permanent, water-impervious and non-biodegradable existence; many are available throughout the automotive, construction and plastics industries.

With the invention, there is acquired not only a device that has unlimited in-ground use, with high overburden sustainability, but one retaining a high degree of flexibility that allows wrapping about an article/structure or compact rolling-up, for ease in handling, storage and shipment.

BRIEF DESCRIPTION OF THE SEVERAL VIEWS OF THE DRAWINGS

Of the Drawings [Caveat—the following illustrations are for explanation only and no sizes nor dimensions should be inferred unless explicitly stated]:

FIGS. 14A and 14B depict, respectively, the support elements preparatory to their engagement with a longeron of an adjacent member and a detail of the discrete element; while.

DETAILED DESCRIPTION OF THE INVENTION

Before commencing this description, the reader is referred to the DEFINITIONS, given above. The materials of construction are well known in the industry and no further mention will be made of them other than that the filter fabric is in common usage, in sheet ("membrane") and mat forms, and the support or stand-off members may be composed of any strong, non-biodegradable resin or polymeric, such as polyamide, polyester or polyvinyl chloride. In short, the physical characteristics of the materials comprising the standoff members should be heat-melt formable to facilitate manufacture by extrusion, casting or injection molding processes. The heat melt character also facilitates fusing of the various elements.

Figure 1:
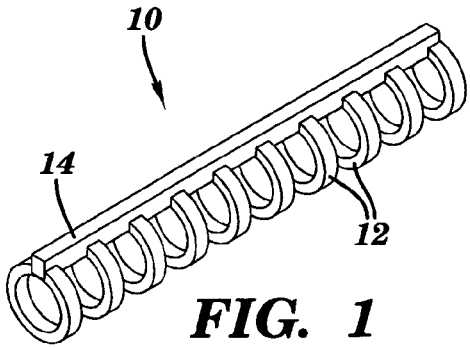
FIG. 1 is a representation of the preferred embodiment for a standoff or support member of the invention.

Referring now to FIG. 1, there is depicted, in the preferred embodiment, a support/standoff member 10 of the invention. It is, substantially, a duct-like or quasi-tubular item comprised of a series of hoop or ring elements 12 that are axially aligned on and integral with a longeron 14. The member is generally produced by injection molding as a unitary item. The particular annular shape is chosen because of its resistance to deformation likely to be caused by centripetal forces, such as overburden of soil or concrete.

Figure 2:
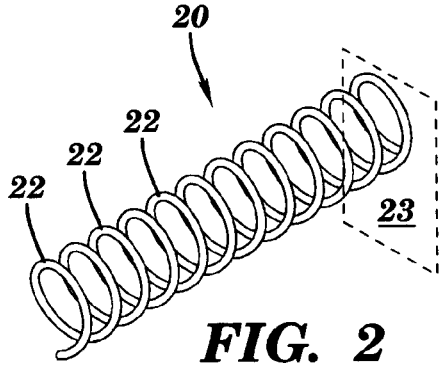
FIG. 2 a representation of an alternate to the preferred embodiment of the standoff or support member of the invention.
Figure 3:
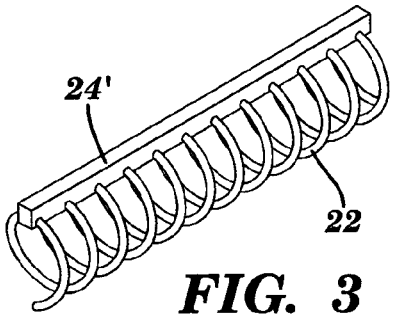
FIG. 3 is a drawing of the FIG. 2 member having a structural reinforcement, termed a longeron.

The alternate support/standoff member is shown in FIG. 2, and is described simply as a coil 20. As is readily apparent, a series of hoops/annuli 22 are, by the nature of a coil, axially aligned, but not discretely closed. Although being made of similar material, the coil lacks the inherent strength of the preferred embodiment support member 10 because there is no structure to confine any one annulus to its median plane 23. To compensate for a hoop's tendency to contract or expand out of it's median plane, the FIG. 3 modification is made. Therein, a longeron 24', peculiar to the coil 20, is added. Whereas the coil is readily made by extrusion techniques, the element of FIG. 3 requires secondary processes that require its alternate embodiment nomenclature, in the instant invention. As was discussed in the above discussion of relevant art, a coil without an intermediate support, such as the filler medium of U.S. Pat. No. 3,965,686, will simply be unable to sustain the great overburdens anticipated in most subsurface emplacements. It is, however, desirable and used where feasible, because of its inherent flexibility— generally as a cross-linking (entwinement) element or when adequately constrained (see FIGS. 7 and 24).

Figure 4:
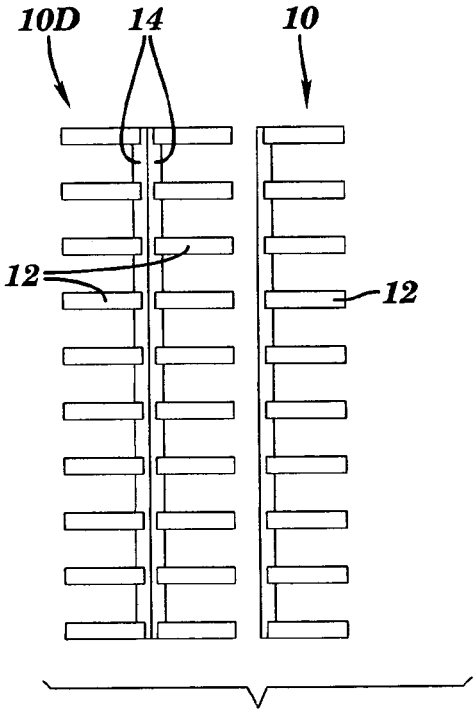
FIG. 4 is a plan view of the FIG. 1 member, in-place and adjacent a compounded version ("doublet") thereof.

FIG. 4 introduces an optional use of the support member 10D, also referred to as a "doublet". The doublet is a cohesion of two member units 10 generally, but not necessarily, along their respective longerons 14. Here, in plan view, the doublet is postured proximate the member unit 10 and parallel to it. Although not shown here, this unit may be axially rotated 180° and the hoops of the unit interleaved with those of the doublet. This arrangement is known as "staggered array". It will be seen in the FIG. 12 description, concerning around-the-corner emplacements.

Figure 5:
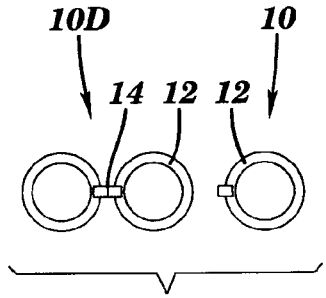
FIG. 5 is an end elevation of the FIG. 4 assembly.
Figure 6:
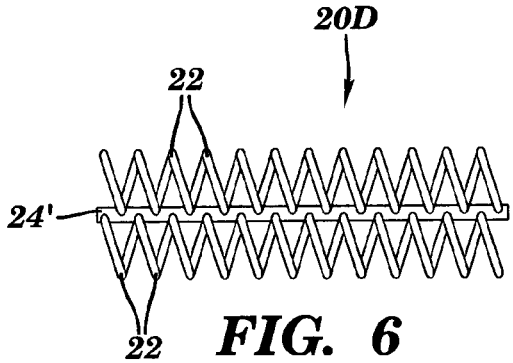
FIG. 6 is a plan view of the FIG. 2 member, in-place and adjacent a doublet version of the FIG. 3 member.

FIG. 5 presents an end elevation of the FIG. 4 array. The members 10/10D may be arrayed in either unit, doublet or mixed assemblage; likewise they may be in parallel, staggered or non-staggered registry, so long as a close proximity is maintained, i.e., there are no intervening or intermediate constraints, such as filler materials. FIG. 6 shows a coil doublet 20D, in plan view. It, along with its unit of FIG. 2 or 3 enjoys almost the same versatility and may be mixed with them, or with the preferred embodiment 10 in standoff arrays.

Figure 7:
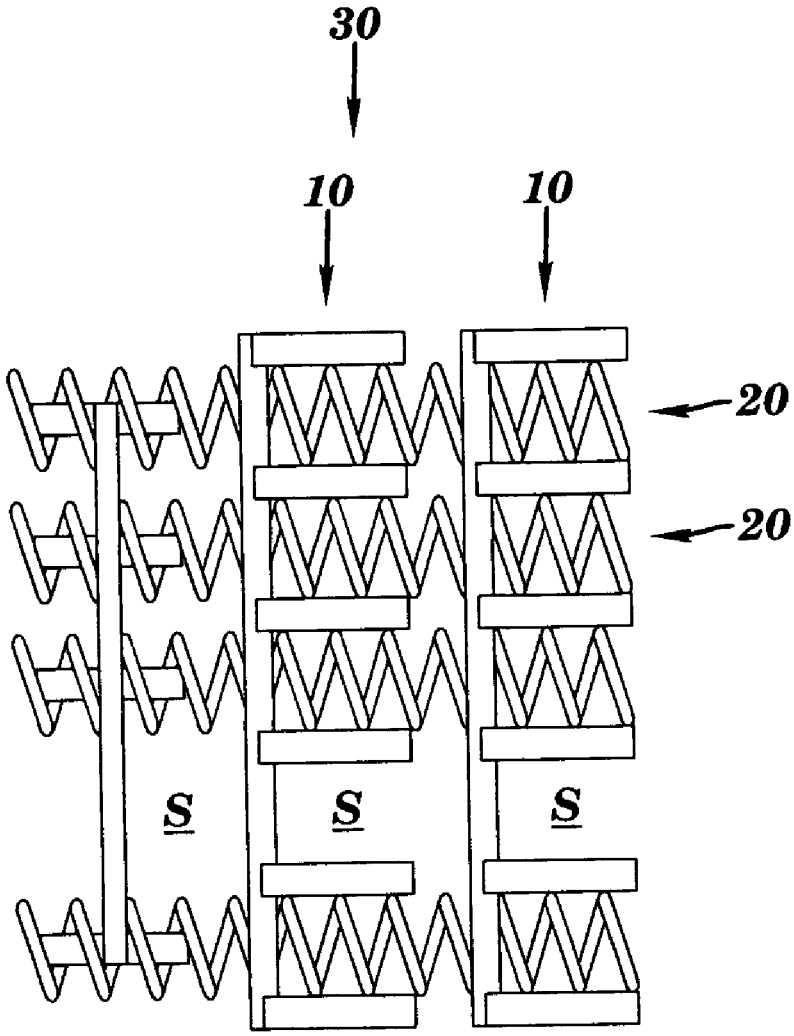
FIG. 7 is a plan view of an optional arrangement of one or both elemental embodiments of FIGS. 1–3.

The aforesaid versatility is clearly seen in FIG. 7, where a highly supportive standoff array 30, comprised of a mix of the preferred embodiment 10 (in parallel arrangement), is cross-linked with the alternate embodiment 20. The coil usage, in this array, neither uses nor requires the strengthening longeron. Other arrangements may be made of either embodiment, with the coil modality free of, or bearing, the longeron 14 (24'). In a production run, the actual arrangement of the hoop members 10/20, as well as their mix and size, will be selected according to the function to be performed. For example, where a "pour through" of concrete is desired, spacing of elements to create voids in the array may be provided. A (small) model of such spacing S is depicted in the figure. Such a provision would, of course, necessitate removal and sealing of any covering, over and under the array at the selected void areas; such would be done in production or at the site of installation.

Figure 8:
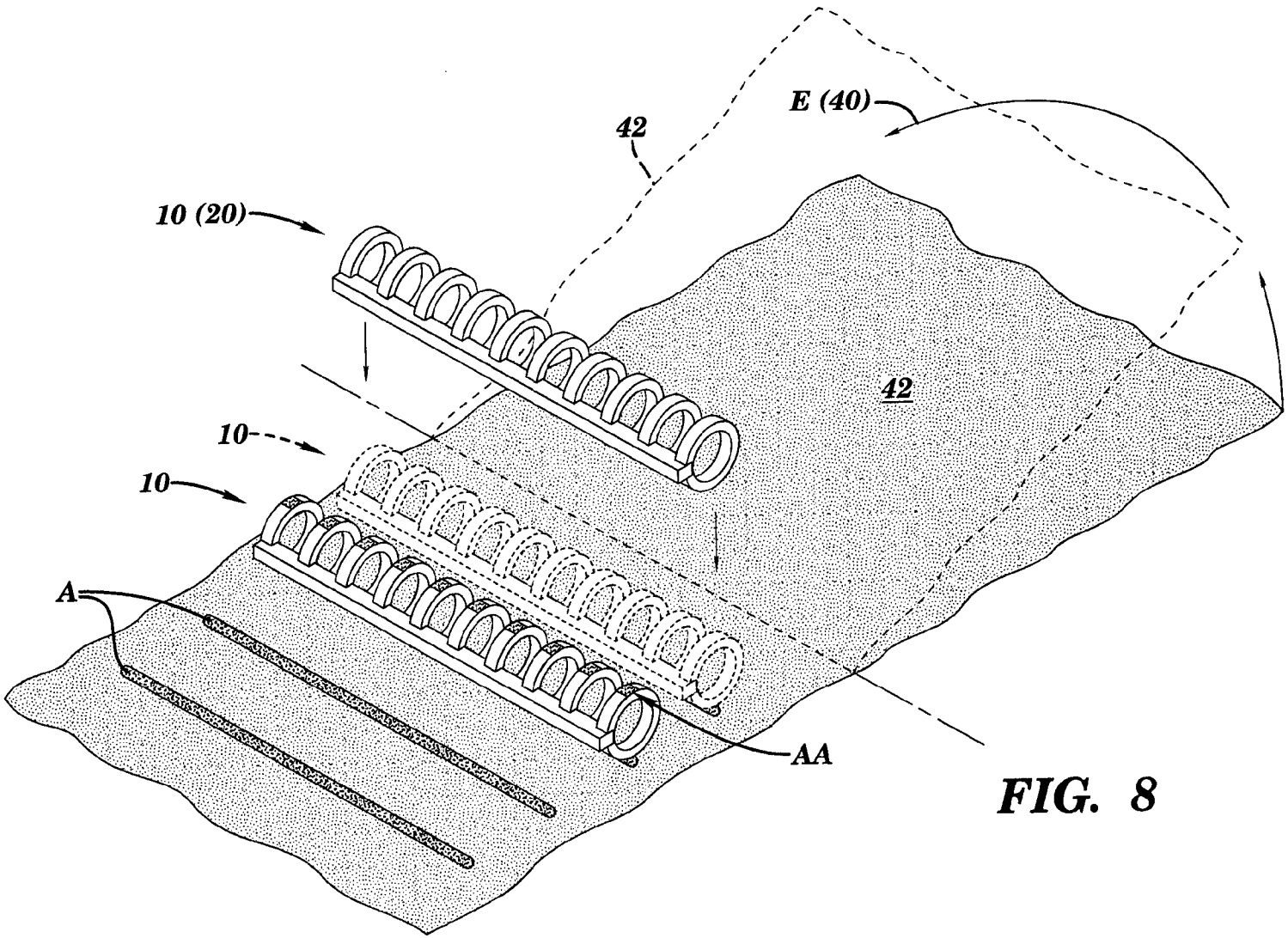
FIG. 8 is an illustration of the confection technique for a small section of the invention sandwich assembly.

From a production standpoint, FIG. 8 shows the assembly of one aspect of the invention 40 (see, FIG. 9: 40) to be straight forward: (1) the desired covering membrane 42 is laid or run out to receive, along desired and discrete portions thereof, a suitable adhesive A for fixing support members 10 (20) to it; (2) the adhesive is disposed on the membrane, in the selected array pattern; (3) the support members are joined to the membrane on the adhesive; (4) additional adhesive AA is deposited on the tops of the fixed members; and, (5) another layer of membrane is folded E(40) over or otherwise placed onto the ensemble to complete the assembly. Such an assembly process is familiar to manufacturers.

Figure 9:
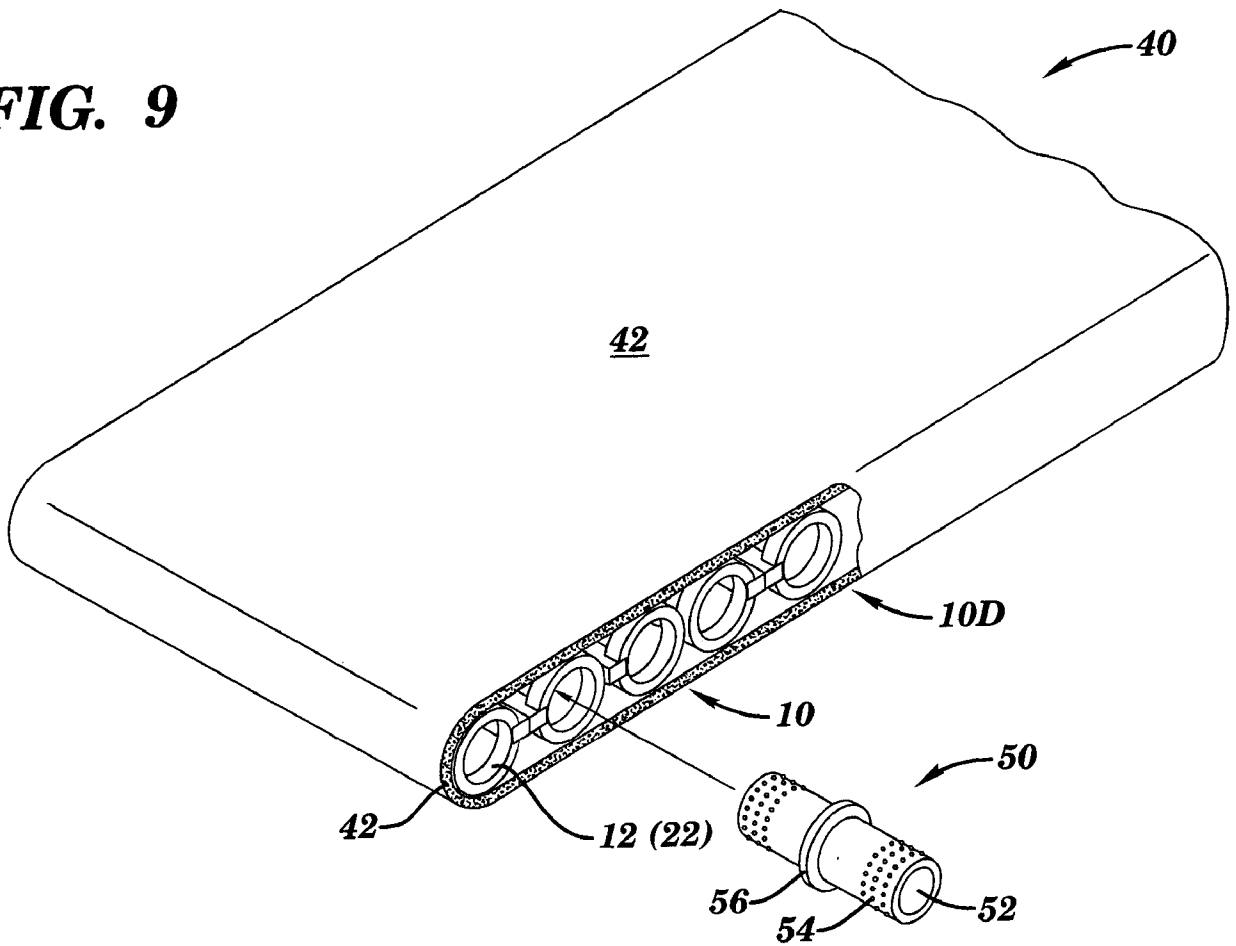
FIG. 9 is a drawing of a model of the invention, diminutive only in its surface area.

Depiction is seen, in FIG. 9, of a model of the assembled invention 40. In this partial cut-away drawing, the supports/stand-offs are a mix of the preferred embodiment, in unit 10 and doublet 10D modes. The membranous covering 42 is a geo-textile filter fabric, now used throughout the industry; it envelops the array. In some installations, and depending on the sizing of the production models, it may be desirable to concatenate the arrays of the invention 40. This being the case, a connector 50 is provided to mate a tubular member with its corresponding member in the concatenated array (not shown). The connector consists of a straight tube 52, a plastic or resin, that is designed to fit snuggly into the tubular members' hoops 12(22). To assure that the tubes are not easily retracted during installation manipulation, a number of detents 54 are provided around the ends of the tube. Too deep an insertion, into the member, is precluded by the presence of a flange 56, circumscribing the middle of the tube 52. In most instances of use, an installer requiring concatenation to ensure continuity of fluid passage through the arrays, need only open ends of the invention, thereby creating "flaps". Concatenation, using only a few of the connectors, can then be finished by sealing the flap ends over the adjoining assemblies. Alternatively, connectors need not be used if the covered, abutting ends of an assembly 40 are taped over with a durable, non-biodegradable adhesive or sealing tape.

Figure 10:
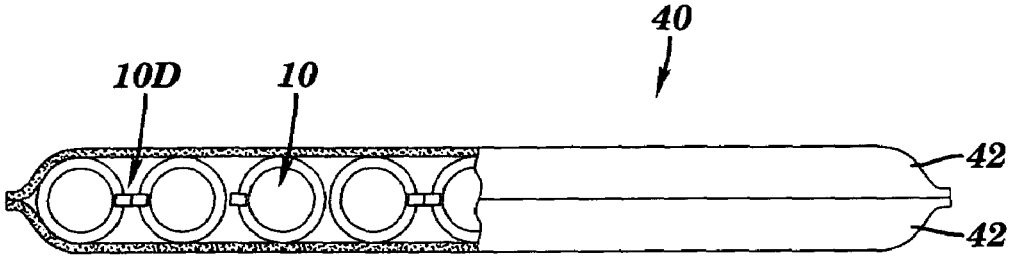
FIG. 10 is a sectionalized end elevation of the FIG. 9 model.
Figure 11:
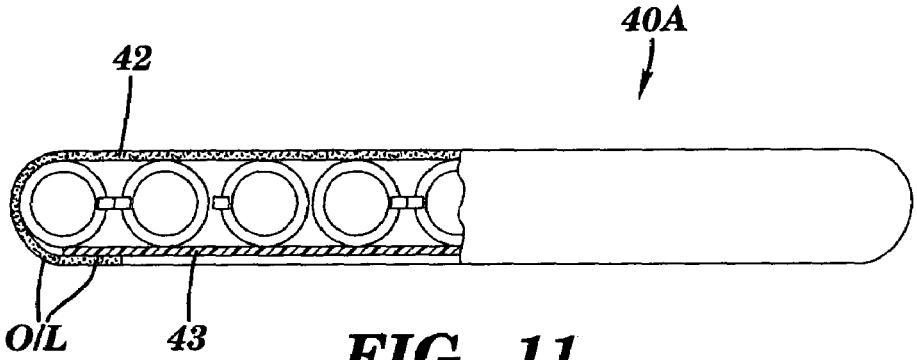
FIG. 11 is a sectionalized end elevation of the FIG. 9 model, bearing an optional partial covering.
Figure 12:
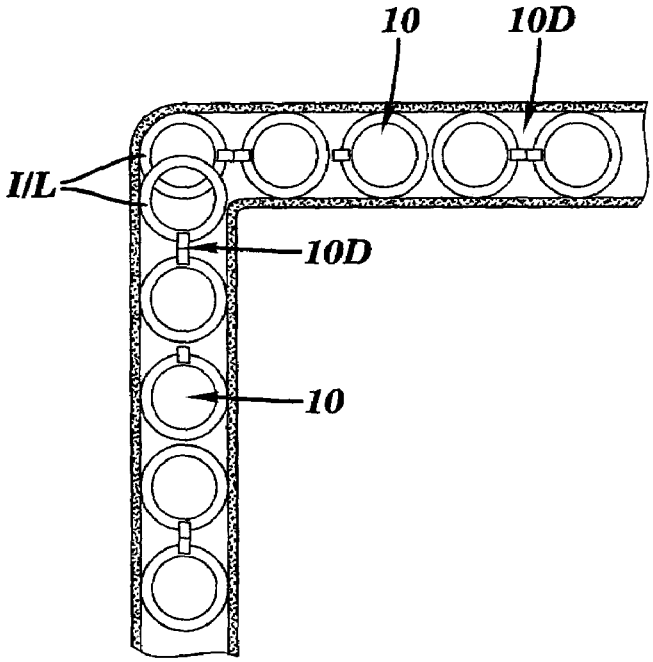
FIG. 12 is an end view depicting the ability of the FIG. 9 device to negotiate an around-the-corner emplacement.

Remaining drawings, FIGS. 10–12, illustrate two options featured in the invention 40/40A, with FIGS. 10 and 11 directed to covering options, and FIG. 12, to a standoff arrangement. It will be noted that FIG. 10 shows the invention 40, enveloped in the filter covering 42 over the top and bottom of the quasi-tubular array, which is comprised of unit 10 and doublet 10D members. For the sake of clarity, no adhesive or alternate stand-off(s) are shown, in any of these three drawings, but it should be reckoned that any of the aforementioned features of the invention are, or could be, used.

FIG. 11 discloses another option in the invention 40A. Here, a partial membranous covering of filter fabric 42 is complemented by a non-biodegradable, water impervious membrane 43. This option finds utility, particularly, when the invention 40A is to be placed onto a surface that is to be sealed against water infusion, e.g., outside basement walls. The amount of actual overlap O/L depends on a particular usage, manufacturers preferences and the membrane bonding techniques to be used.

FIG. 12 shows an end elevation of the invention featuring yet another optional arrangement of standoff/support members 10 and 10D. The inventor's specifications call for a parallel arrangement of quasi-tubular supports in near or close proximity, that is, eschewing any filler medium between adjacent supports and yet fully contemplating a physical communication between these members (ibid. FIG. 7). In FIG. 12, the referenced optional arrangement is termed a parallel, interleaved I/L disposition. The arrangement is simply an alternating, forward-back ("staggered") placement of the supports, of either type (two doublets shown) throughout the array, in pre-selected periodicity. This option facilitates an easier folding or bending of the invention around a corner, thus allowing sharper turns in its placement. Of course, adjustments in either adhesive application (fixture) or membrane looseness may be necessary for such a feature; but they are well within the competence of modern manufacturers.

Figure 20:
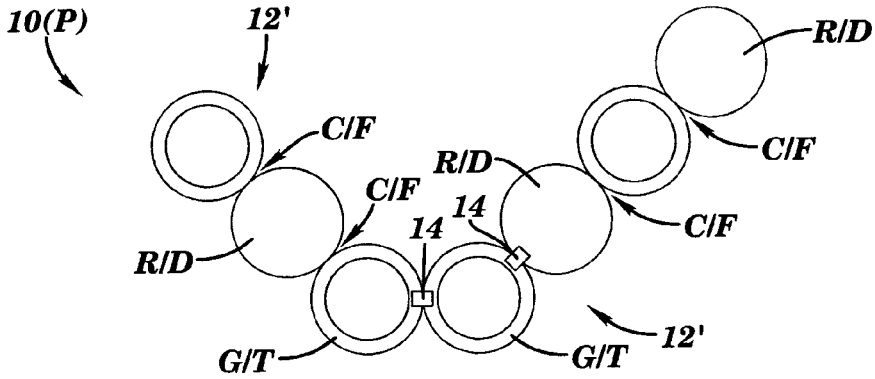
FIG. 20 illustrates an arbitrary poly-formation of invention.

It should be recognized that the fundamental aspects of this invention can be realized with, for example, quasi-tubular stand-offs of different nomenclature, such as rigid, perforated pipes/tubules/rods—but, flexibility may be lost to some degree; a trade-off for the ability to sustain heavier overburdens (see, e.g., FIG. 20 and description).

The clear advantage of using the standoff elemental structures of the invention is seen in the fact that the gap between adjacent hoop planes (FIG. 2: 23), of either embodiment, can exceed the nominal thickness of the discrete hoops. Such advantage is not shared by the multitude of extant drain tubes. Also, reading this disclosure, one may rightly infer that the planar array (FIG. 7) may take on any planar geometry, flex to the degree allowed by stand-off size and arrangement, and be covered by both permeable/non-permeable membranes, on either one or both faces of the array. Used not merely to facilitate around-the-corner installation, as depicted in FIG. 12, the interleaved element arrangement, in either embodiment 10/20, is used by the inventor to augment the support members' strength. This strengthening becomes necessary under very high overburden conditions and, as an option, provides a dual function to the interleaving practice.

Having discussed the fundamental aspects of the invention, it becomes incumbent upon this inventor to offer the reader some insight as to the versatility inherent in the use of the invention's tubule/duct members 10/20, as well as their hybridizing potential with rods, perforate tubes and other drainage adjuncts. The latter portion of this disclosure is therefore directed to the combinational modalities that become apparent once the invention is understood.

Figure 14A:
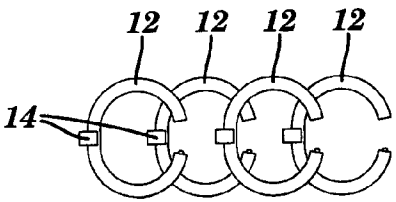
Figure 14B:
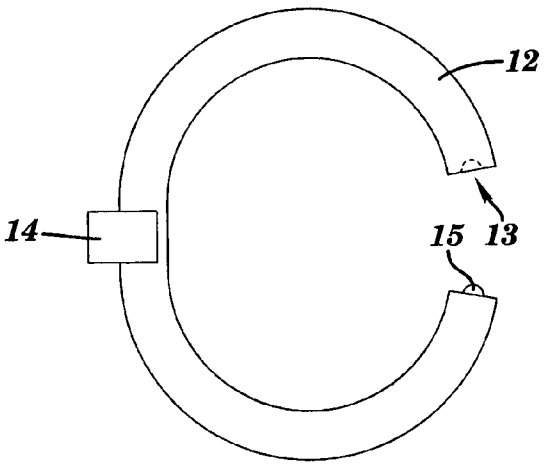
Figure 14C:
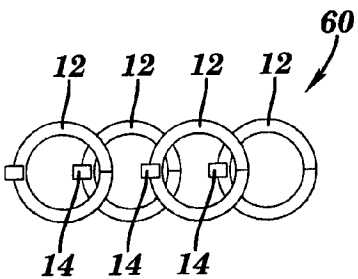
FIG. 14C presents an end elevation of the FIG. 13 construct.
Figure 13:
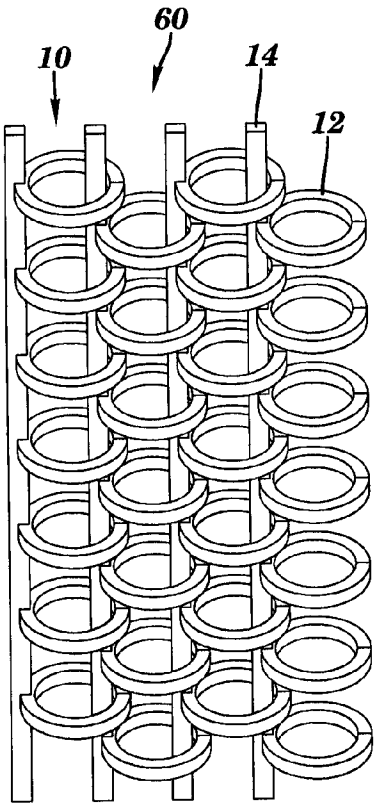
FIG. 13 shows an alternate construction of the preferred embodiment requiring no coupling membrane.

Turning now to FIGS. 13–14C, the basic interlinked mode 60 of members 10 is acquired by encirclement of the longeron 14 (hoop) of one member 10 by the elements 12 of the adjacent member; the end elevation of this modality being shown in FIGS. 14A (open) and 14C (closed). The hoop elements are made in the manner of a book ring binder, in that they are a relatively thick, but bendable polymer. As shown in FIG. 14B, the hoop elements 12 are afforded breaks to facilitate opening, for the potential encirclement of a longeron 14 of another member (FIG. 14A). Subsequently, the elements are closed and a snap-in detent 15 is inserted into depression 13, thus securing the encirclement.

Figure 15:
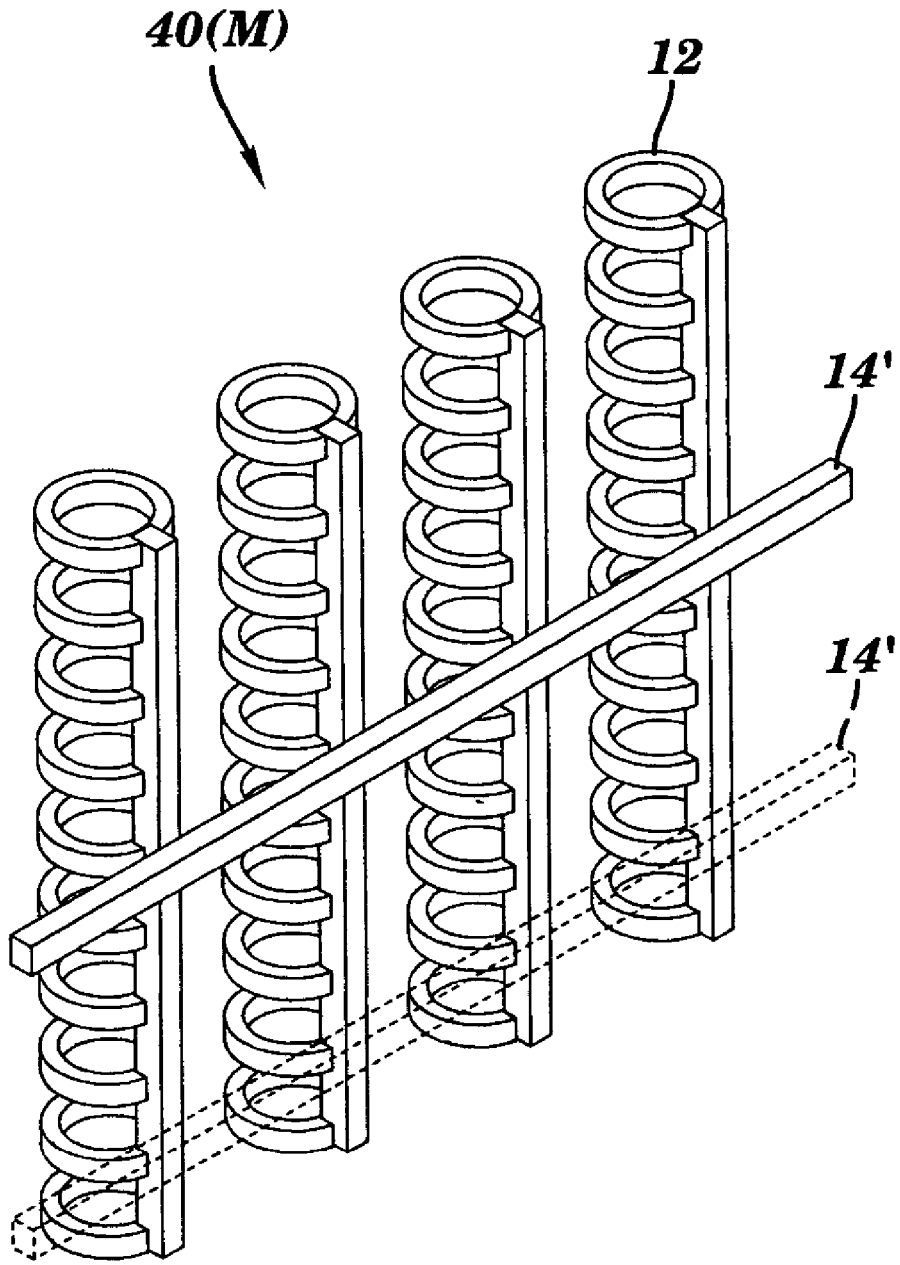
FIG. 15 shows the construct of FIG. 8 employing stringer(s), in lieu of coupling membrane(s)

FIG. 15 is an illustration depicting an array 40(M) akin to that of FIG. 8, but lacking the coupling membrane—in favor of stringer 14' coupling. The number, as well as dimensions, of stringers used will depend on manufacturers and users objectives. This embodiment will find high value in installations that require in situ preparation of the drainage system. This matrix can be cut and stacked, after many a fashion, and covered with stone and/or fabric. The various options shown in FIGS. 16–20 are particularly suitable for such installations.

Figure 16:
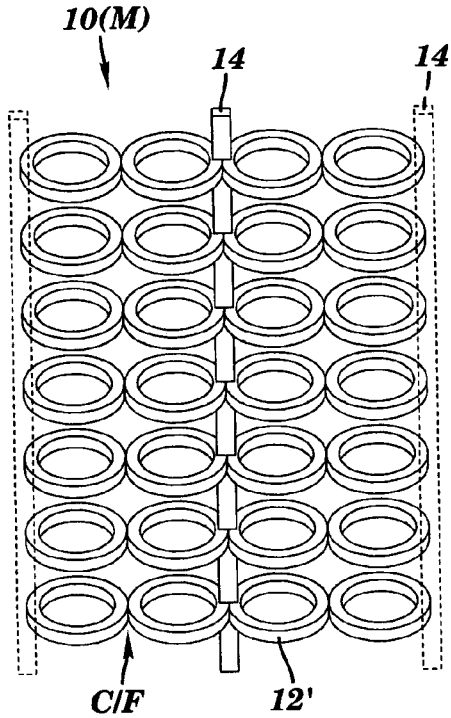
FIG. 16 depicts a modification, a further compounding, of the FIG. 4 "doublet", and FIG. 17 an end elevation thereof.
Figure 18:
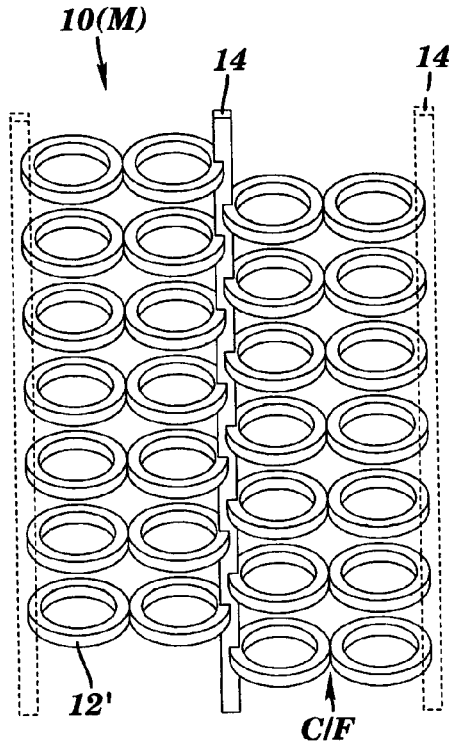
FIGS. 18 and 19 are correlative illustrations, respectively, of the FIGS. 16 and 17 modification in the staggered arrangement of compounded members.
Figure 17:
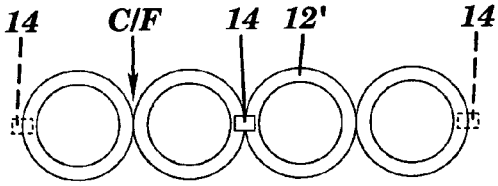
Figure 19:
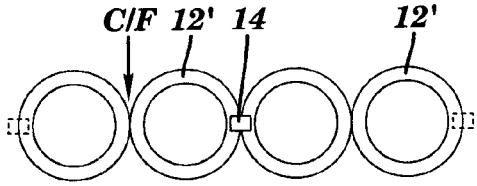

Referring specifically to FIGS. 16 and 17, there are seen, respectively, a modification 10(M) of the FIG. 4 "doublet" and an end elevation thereof In orthogonal extension from off the common longeron 14, the uniquely distinct, multiple element 12 nonetheless has the same characteristics as a singular geometric shape of the FIG. 4 article. The multiple elements can be made by casting, molding or by stamping and cementing/fusing C/F the individual shapes or members. FIGS. 18 and 19 differ from the previous two drawings only in that one of the elemental arrangements is staggered with respect to the other. In both variations of this modification, the elements can be readily extended by concatenating the geometric shapes outward in their same (common) plane. As will be seen in the following drawing, one is not restricted to a simple planar array, nor a single type element.

The flexibility in design and assembly of this invention can be better appreciated with reference to FIG. 20. Here an end elevation of a poly-formation ("polyform") 10(P) of the invention reveals a "U" formation of the elements 12'. Using the invention to its fullest potential, and in keeping with all disclosure made herein, one readily sees that the various elements and members can be had to form many varied formations such as "L", "T", "U", "V", "W", "X" and "Y" patterns and combinations thereof; these patterns effect "oblique-planar" structures and can be formed using cementing or fusing C/F.

Figure 23:
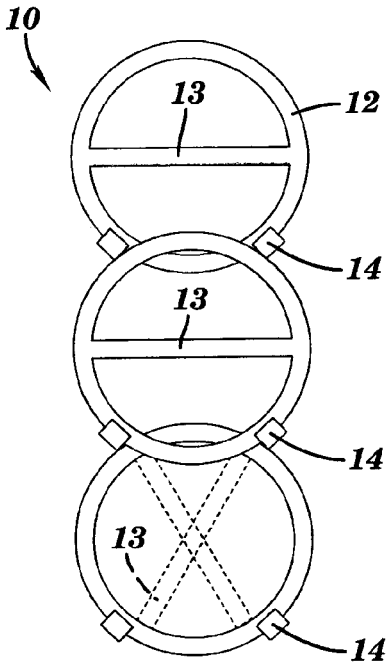
FIG. 23 presents an end elevation of stacked members of the invention.

Aside from the fact that, in FIG. 20 one planar array is no longer co-planar the other, but in an angular relationship (oblique plane) therewith, a very great distinction is presented in the geometric shapes themselves. The preferred embodiment, arrays of coils or tubules, the latter using elements created by employing geometric shaped articles, is by now quite familiar. Although a plan view is not shown, FIG. 20 and its description suffice to explain, in conjunction with the invention structures now known, namely FIGS. 8–12, how the familiar three-dimensional matrix plane (ordinary planes or oblique intersecting) is acquired using other structures, with or without the heretofore disclosed elements/members. FIG. 23

The reader's attention is called to the members R/D of FIG. 20. As an option, these may be solid discs (the D) used with the ring or hoop shapes 12. Moreover, in a totally different modality, these R/D members are polymeric rods (the R), to be used in conjunction with the shown G/T elements, which consist of tubules 10 (the G) or perforated tubing (the T). The resultant array is essentially planar, somewhat less flexible, capable of sustaining much greater overburden than the designs of FIGS. 1–19.

Figure 21:
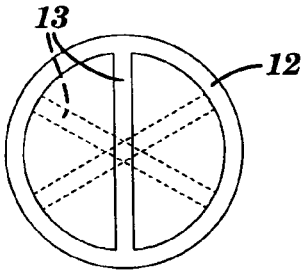
FIGS. 21 and 22 depict end elevations of suggested support elements (geometric shapes) of the invention, with optional bracing features.
Figure 22:
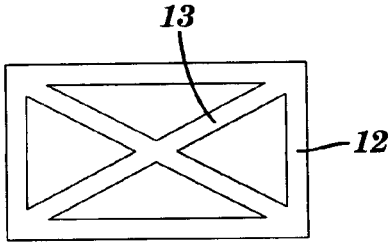

Turning now to FIGS. 21 and 22, there is shown, respectively, a circular or arcuate element 12 and a rectilinear. The novelty shown here is the structural reinforcements 13, which may be indicated when the invention is designed to sustain heavy burdens such as rock/stone or concrete.

FIG. 23 discloses employment of the devices of FIGS. 21 and 22 using members of the invention 10, but crafted with two longerons 14 and the interleaving technique. This stacking of elongated members contemplates a larger scale installation in ditches, against subsoil walls and the like. The invention appears here in a more massive form and is usually assembled member-by-member, in situ; thus, the elements bear reinforcement structures 13.

Figure 24:
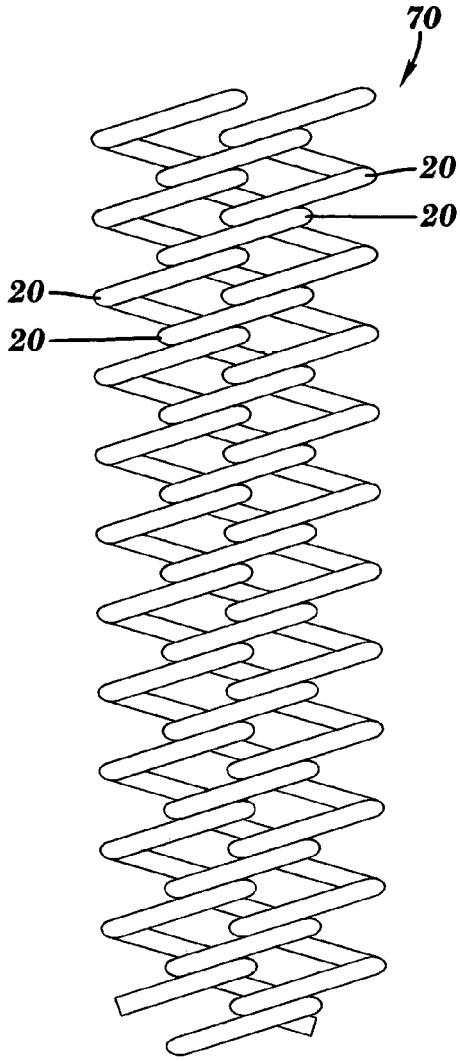
FIGS. 24 and 25 show, respectively, a plan view and end elevation of the FIG. 2 member in a compound construct.
Figure 25:
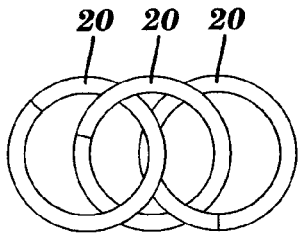

Final to this disclosure, FIGS. 24 and 25 show in plan view and end elevation, respectively, an embodiment 70 alternate to the preferred, using the plain coil 20. Two or more such coils are intertwined by a spiral threading of one through the other. The result is a flexible, adjustable planar matrix characteristic of the invention. As with all embodiments herein, this also may be cloaked with the earlier designated membranous covers.

Improvements of this invention and applications thereof, according to the disclosure, are commended to the field consistent with the appended claims.

What is claimed is:

1. A drainage support matrix defined by an article that manifests an obverse face and a reverse face, said article comprising a plurality of duct members, a first duct member in unobstructed adjacency with a second duct member, said first duct member comprised of an arrangement of multiple elements of a select parametric geometry, each of the multiple elements having a central void and disposed in coaxial alignment with all other said multiple elements of the arrangement.

2. The matrix of claim 1, wherein said parametric geometry of the elements is one selected from the set of geometries consisting of circles, ellipses and quadrilaterals.

3. The matrix of claim 2, wherein said plurality of the duct members are comprised of multiple said parametric geometries that define a coil.

4. The matrix of claim 3, wherein said plurality of the duct members are coupled to each other by at least one stringer.

5. The drainage support matrix of claim 1 further comprising a membranous cover over at least one face thereof.

6. A drainage support matrix defined by an article that manifests an obverse face and a reverse face, said article comprising at least one duct member, the duct member configured for disposition in unobstructed adjacency with another duct member and itself comprised of an arrangement of multiple elements of a select parametric geometry, wherein said parametric geometry of the elements is one selected from the set of geometries consisting of circles, ellipses and quadrilaterals, each of the multiple elements having a central void and disposed in coaxial alignment with all other said multiple elements of the arrangement, further comprising two or more or the duct members and each are comprised of multiple said parametric geometrics that define a coil, wherein said two or more of the duct members are coupled to each other by their intertwinement.

7. A drainage support matrix defined by an article that manifests an obverse face and a reverse face, said article comprising at least one duct member, the duct member configured for disposition in unobstructed adjacency with another duct member and itself comprised of an arrangement of multiple elements of a select parametric geometry, wherein said parametric geometry of the elements is one selected from the set of geometries consisting of circles ellipses and quadrilaterals, each of the multiple elements having a central void and disposed coaxial alignment with all other said multiple elements or the arrangement, wherein the arrangement of multiple elements of said at least one duct member, being in said co-axial alignment, are joined integrally to at least one longeron and each said element of said multiple comprises one or more of said set of geometries lying within a common plane.

8. The matrix of claim 7, wherein said two or more of the duct members are coupled fixedly to each other by at least one stringer.

9. The matrix of claim 7, wherein said two or more of the duct members are coupled movably by encirclement of the elements of one about said at least one longeron of the oilier, with an interleaving of the elements of said one with the elements of said other.

10. The matrix of claim 7, wherein said two or more of the duct members each include two longerons and comprise a vertical plan by stacking one duct upon another in co-longitudinal registry.

11. A drainage support array comprising two or more skeletal ducts in unobstructed adjacent registry, each said duct further comprising an arrangement of multiple elements of a hollow parametric geometry, said elements configured for interleaving and disposed in a spaced coaxial alignment, thereby effecting an overall skeletal profile.

12. The array of claim 11, wherein said hollow parametric geometry of the elements is at least one selected from the set of geometries consisting of arced and multilateral shapes.

13. The array of claim 11, further comprising a covering selected from any of the materials consisting of filter and impermeable fabrics.

14. A drainage support array comprising two or more skeletal ducts in unobstructed adjacent registry, each said duct further comprising an arrangement of multiple elements of a hollow parametric geometry, wherein said hollow parametric geometry of the elements is at least one selected from the set of geometries comprising of arced and multilateral shapes, and elements configured for interleaving and disposed in a spaced coaxial alignment, thereby effecting an overall skeletal profile, wherein said multiple elements are joined integrally in alignment along and to one or more substantially parallel and flexible longerons, and each said element is defined by one or more of said hollow parametric geometries.

15. The array of claim 14, wherein said two or more ducts are coupled to each other by one or more stingers.

16. The array of claim 14, wherein said array effects an adjacent, staggered and co-longitudinal arrangement of two or more said ducts that is facilitated by interleaving of the said elements.

17. A drainage support array comprising two or more flexible skeletal ducts coupled in an unobstructed parallel adjacent registry, each said duct further comprising a coil of non-biodegradable material, each of said ducts adapted for their mutual entwinement and for entwinement with other multi-elemental skeletal ducts, and each said duct further adapted for their mutual interleaving and interleaving with said other multi-elemental skeletal ducts.

18. The array of claim 17, further comprising a covering selected from any of the materials consisting of filter and impermeable fabrics.

19. A drainage support array comprising two or more flexible skeletal ducts coupled in an unobstructed parallel adjacent registry, each said duct further comprising a coil of non-biodegradable material, each of said ducts adapted for their mutual entwinement and for entwinement with other multi-elemental skeletal ducts, and each said duct further adapted for their mutual interleaving and interleaving with said other multi-elemental skeletal ducts, wherein hoops of said coil are integrally joined along and to one or more substantially parallel and flexible longerons.

20. The array of claim 19, wherein said array effects a vertical and alternating, staggered and co-longitudinal stacking of two or more said ducts that is partially facilitated by said interleaving and substantially effected by said hoops resting upon said one or more longerons.

21. A drainage support array comprising two or more flexible skeletal ducts coupled in an unobstructed parallel adjacent registry, each said duct further comprising a coil of non-biodegradable material, each of said ducts adapted for their mutual entwinement and for entwinement with other multi-elemental skeletal ducts, and each said duct further adapted for their mutual interleaving and interleaving with said other multi-elemental skeletal ducts, wherein said two or more ducts are coupled to each other by one or more stringers disposed transversely to said ducts in said parallel adjacent registry.

22. A drainage support defined by a non-biodegradable matrix comprising at least a first series of elements having pre-selected geometric shapes, the elements each being extendable with said shapes and having optional central voids, said each element disposed in essentially orthogonal extension from a common and integrally bonded longeron and concomitantly disposed along the longeron in a spaced, coaxial relationship with at least another element of said at least first series, and all said elements being selected from a set of said geometric shapes having elevations consisting of circles, ovals, rectilinear forms and concatenations thereof.

23. The support of claim 22 further comprising a second series of the elements in orthogonal extensions from the longeron and disposed in the same spaced, coaxial relationship as, and adjacent, the first series.

24. The support of claim 22 further comprising a second series or more of the elements in orthogonal extension from the longeron and disposed in the same spaced, coaxial relationship as, and angularly offset, the first series, to form and elevations in various profiles that include an L, a T, a U, a V, a W, an X, a Y and combinations thereof, and wherein the first and the second or more series of elements are optionally staggered with respect to each other.

25. The support of claim 22, further comprising a membranous covering.

26. The support of claim 25, wherein said membranous covering fully surrounds said matrix.

27. A drainage support matrix defined by an article that manifests an obverse face and a reverse face, said article comprising at least one duct member, the duct member configured for disposition in unobstructed adjacency with another duct member and itself comprised of an arrangement of multiple elements of a select parametric geometry, wherein said parametric geometry of the elements is one selected from the set of geometries consisting of circles, ellipses and quadrilaterals, each of the multiple elements having a central void and disposed in coaxial alignment with all other said multiple elements of the arrangement, further comprising two or more of the duct members and each are comprised of multiple said parametric geometrics that define a coil, wherein said at least one duct member is interlinked with said another duct member.

28. The matrix of claim 27, further wherein said at least one duct member is adjoined with said another duct member.

29. A drainage support array comprising two or more skeletal ducts in unobstructed adjacent registry, each said duct further comprising an arrangement of multiple elements of a hollow parametric geometry, wherein said hollow parametric geometry of the elements is at least one selected from the set of geometries consisting of arced and multilateral shapes, said elements configured for interleaving and disposed in a spaced coaxial alignment, thereby effecting an overall skeletal profile, wherein said two or more skeletal ducts are interlinked with each other.

30. The array of claim 29, further wherein said two or more skeletal ducts are adjoined with each other.

31. A drainage support array comprising two or more flexible skeletal ducts coupled in an unobstructed parallel adjacent registry, each said duct further comprising a coil of non-biodegradable material, each of said ducts adapted for their mutual entwinement and for entwinement with other multi-elemental skeletal ducts, and each said duct further adapted for their mutual interleaving and interleaving with said other multi-elemental skeletal ducts, wherein said adjacent ducts are interlinked with each other.

32. The array of claim 31, further wherein said adjacent ducts are adjoined with each other.

* * * * *